United States Patent [19]

Hendrischk

[11] 4,255,062

[45] Mar. 10, 1981

[54] MATRIX PRINT HEAD

[75] Inventor: Wolfgang Hendrischk, Neu-Ulm, Fed. Rep. of Germany

[73] Assignee: Mannesmann Aktiengesellschaft, Dusseldorf, Fed. Rep. of Germany

[21] Appl. No.: 25,580

[22] Filed: Mar. 30, 1979

[30] Foreign Application Priority Data

Apr. 17, 1978 [DE] Fed. Rep. of Germany ..... 2817154

[51] Int. Cl.[3] ..... B41J 3/12

[52] U.S. Cl. ..... 400/124

[58] Field of Search ..... 400/124

[56] References Cited

U.S. PATENT DOCUMENTS

| | | | |
|---|---|---|---|
| 3,198,306 | 8/1965 | Bachman | 400/124 |
| 3,405,392 | 10/1968 | Milne et al. | 400/124 |
| 3,627,096 | 12/1971 | Finnegan | 400/124 |
| 3,900,094 | 8/1975 | Larsen et al. | 400/124 |
| 4,091,909 | 5/1978 | Lee | 400/124 |

FOREIGN PATENT DOCUMENTS

| | | | |
|---|---|---|---|
| 2629763 | 1/1978 | Fed. Rep. of Germany | 400/124 |
| 2729495 | 2/1978 | Fed. Rep. of Germany | 400/124 |
| 2758794 | 7/1978 | Fed. Rep. of Germany | 400/124 |
| 1531666 | 5/1968 | France | 400/124 |

OTHER PUBLICATIONS

Dials et al, "Printing of Display Characters", IBM Technical Disclosure Bulletin, vol. 22, No. 3, p. 1086, 8/79.

Raider, "Additional Print Positions. . ., " IBM Technical Disclosure Bulletin, vol. 17, No. 12, p. 3560, 5/75.

Darwin, "Matrix Printer" IBM Technical Disclosure Bulletin, vol. 18, No. 9, pp. 2762–2763, 2/76.

Ranta et al, "Nonbreakable Print Wires. . .," IBM Technical Disclosure Bulletin, vol. 20, No. 8, p. 2938, 1/78.

*Primary Examiner*—William Pieprz

*Attorney, Agent, or Firm*—Smyth, Pavitt, Siegemund, Jones & Martella

[57] ABSTRACT

A print head for matrix printing has twelve needles whose front ends are arranged in three columns and seven rows, whereby the middle one holds only two needle ends in the second and sixth row, while the other row positions each of the two outer columns hold one needle tip. This arrangement permits a significant print speed increase for a moderate weight increase, and reduces the number of weak spots in the needle guiding mouth piece.

3 Claims, 6 Drawing Figures

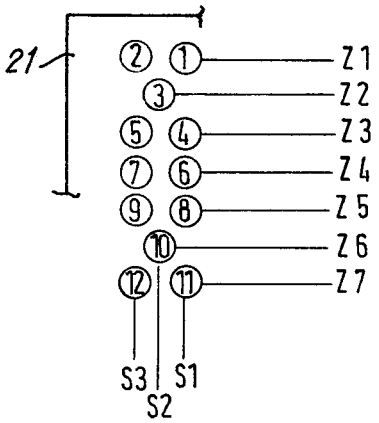
Fig.2
Fig.3
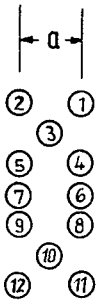
Fig.4
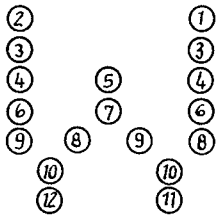
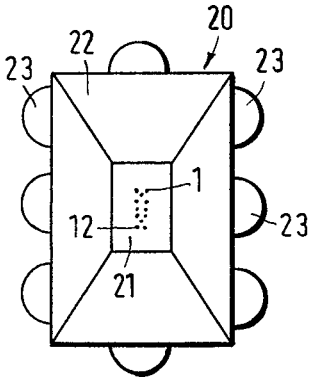
Fig.1
| | 1 | 2 | 3 | 4 | 5 | 6 | 7 | 8 |
|---|---|---|---|---|---|---|---|---|
| 1 | | | | | | | × | |
| 2 | | | × | | | | | |
| 3 | | × | | | | | | × |
| 4 | × | | | | | | × | |
| 5 | | | | | | × | | |
| 6 | × | | | | | | × | |
| 7 | | | | | | × | | |
| 8 | | | × | | | | × | |
| 9 | | | × | | | | × | |
| 10 | | | × | | | | × | |
| 11 | | | | | | × | | |
| 12 | | | | × | | | | |
12×8
Fig.5
Fig.6
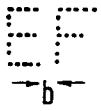

MATRIX PRINT HEAD

BACKGROUND OF THE INVENTION

The present invention relates to matrix printers and more particularly, the invention relates to print heads for and in matrix printers.

Conventional print heads of the type to which the invention pertains are usually constructed in that plural print elements, such as fairly long needles, are disposed to have their front ends or tips aligned vertically and in a mouth piece thereby defining a print column for any character. "Vertical" is to mean in relation to a horizontal extension of lines to be printed, horizontal in that sense being also the direction of relative advance of the print head across the printing surface during printing of one line.

Printing proper results from individually activating the elements such as pushing the needles forward by solenoid action, so that the tip of such an activated needle hits the ink ribbon and the paper. The head advances horizontally across the printing surface (e.g. paper) transversely to the direction of needle movement as well as to the vertical column, so that characters are composed from dots produced in steps through individual and selective activation and non-activation of the needles.

The German printed patent application No. 2,679,763 suggests a modification in that in addition to seven such print elements whose tips are arranged in a column, one provides a second column with additional but less than seven elements, i.e. only three. These three elements are located so that in many instances one can print in two columns at once, as these three elements are placed in positions frequently used in that they are horizontally in line, respectively, with three needle tips of the first column. The speed of printing can be increased accordingly. Of course, one will not always be able to print two columns at once, so that the speed cannot really be doubled. For this it appears that one would need a complete second column having also seven print elements. Moreover, the appearance of the characters is not quite satisfactory if one prints under such a limitation. In other words, this type of arrangement is a compromise between speed increase and appearance. Moreover, one still has to consider the maximum cycle rate with which a needle operating solenoid can be activated.

It can readily be seen that providing a full second column of print elements requires exactly doubling the number of print elements and of their drives. Consequently, the head will be larger and much heavier. More power is needed to drive such a head across the paper. A similar situation was actually encountered in a twelve-needle head as proposed in German printed patent application No. 2,729,495. The rather heavy head, however, was operated in the flying mode, i.e. it did not stop for printing any column. Clearly, a heavy head is more difficult to stop accurately.

Another problem encountered for and in multiple print heads relates to the space requirements. The print needles are required to have their front ends or tips placed rather closely, corresponding to the dimensions of the characters to be printed. The solenoids for each needle are comparatively large, and the needles must be guided in a curved path accordingly. Clearly, this clustering and needle guiding becomes more and more of a problem if the number of needles and solenoids clustered is increased. The French Pat. No. 1,531,666 shows a multiple column print head and attempted to solve the problem by laterally spacing the columns rather far from each other. Consequently, one column is still occupied with printing a character while another column begins already to print the next character. This kind of arrangement complicates the control of the print elements significantly, one has to call on two character patterns at the same time or in overlapping relation.

Another problem is the following. The mouth piece of the print head into which one runs the needles, have their bores rather closely spaced, particularly in the region of the front ends. The reason for this close spacing is, of course, the desire to print dots as close to one another as possible, so that the printed dots merge. The wall thickness between adjacent bores in the head may be as thin as 0.03 mm, which is about one mill. The thin barrier between two adjacent bores is subjected to significant wear when the needles move back and forth. This is particularly the case for those needles which are strongly curved because of the lateral offset of their activating solenoids. One has tried to avoid these trouble spots by not placing the print needles along a vertical line, but arranging them in two columns with a staggered arrangement of the ends. See also German printed patent application No. 2,119,416. Staggering the needles does indeed solve the problem of too weak a barrier between adjacent needle guiding bores; it does not improve print speed but actually slows it down.

DESCRIPTION OF THE INVENTION

It is an object of the present invention to provide a new and improved print element arrangement which permits an increase in print speed without encountering the deficiencies outlined above, thus avoiding weak spots as much as possible, avoiding excessive weight and generally improves the appearance of the characters printed.

In accordance with the preferred embodiment of the invention, it is suggested to provide a seven row print head (i.e. a print head having print elements arranged so that seven rows can be printed in the (horizontal) direction of relative advance between head and print surface during printing of a line) with altogether twelve print elements, such as solenoid operated needles whose front ends or tips are arranged in a mouth piece of the head in three vertical columns, two outer ones and a middle one, whereby in each of the two outer ones the tips are arranged in the first, third, fourth and fifths and sevenths row positions, and the middle column has just two tips, one in each of the second and sixth row position.

This arrangement reduces the number of weak spots and the weight of the head is not significantly increased over a seven needle head. On the other hand, the print speed can readily be increased since in several print positions needles of different columns may be activated, while the cycle rate and frequency of activation of any head is reduced relative to the rate of progression between sequential print positions. For a given head activation cycle rate, the print speed can thus be increased twofold.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a front view of a print head for a matrix printer improved in accordance with the present invention;

FIG. 2 is an enlarged view of a portion of FIG. 1 illustrating the pattern of the needle tips in this print head;

FIG. 3 is similar to FIG. 2 but drawn to a smaller scale to be comparable to FIG. 4;

FIG. 4 illustrates the character W as composed of print dots, indicating further the individual needles that were activated to print the respective dorts;

FIG. 5 is a table indicating in which print position (numbers across the top), which needle (numbers along left-hand margin) was activated to print the character as shown in FIG. 4; and FIG. 6 is a schematic view of two characters as printed, denoting further a relative spacing.

Proceeding now to the detailed description of the drawings, FIG. 1 illustrates a front view of a matrix print head 20. This head has a mouth piece 21 with apertures arranged in a particular pattern described in detail below. These twelve apertures or bores hold and guide printing needles such as 1, 12 and others. The front ends or tips of these needles are visible in the front view of the head. The head includes additionally a housing 22 in which mouth piece 21 is mounted.

The rear of the housing serves as support for solenoids such as 23 which, respectively, drive the print needles. These solenoids are mounted in clusters; eight of them are visible in the view of FIG. 1, and four additional solenoids are mounted directly in back of the visible front of this figure. The needles they activate are thus curved only very little.

FIG. 2 illustrates somewhat schematically but on a greater scale the front view of mouth piece 21. The front ends or tips of and the print needles themselves, are identified by circles and the identifying numbers 1 through 12 are, respectively, inserted. The arrangement of the needles is further identified by rows and columns.

As can be seen, the needles define a column pattern of three columns S1, S2 and S3. Moreover, the needle ends are arranged on seven print lines Z1 through Z7. The arrangement is a critical one. Moreover, it is symmetrical. The two outer columns S1 and S3 hold similarly positioned (as far as rows are concerned) needles; the center column S2 has only two needles. Moreover, (a) none of the columns has a needle in each row; (b) the two outer columns have needles in the same rows; (c) the middle column holds needles in only those rows (Z2, Z6) in which the outer columns do not have needles.

In other words, column S1 and S3 have needles in rows Z1, Z3, Z4, Z5 and Z7 (five each); column S2 has needles only in two rows, 3 and 10. Moreover, the arrangement is also symmetrical with respect to middle row 24.

The pattern is repeated in FIG. 3, showing also the outer column spacing a. This spacing is to be smaller, or at the most, equal to the spacing b between two characters (FIG. 6). The pattern has been repeated in FIG. 3 for purposes of better comparison with FIG. 4. This figure shows printout of the character "W" in altogether seven print columns. Printout results, of course, by selective activation of the respective needle solenoids for the several print columns and in different print positions of the head.

The columns of the head, i.e. the spacing a between three columns covers a similar three column area on the print sheet. Thus, during five successive print positions (out of eight), all three needle tip columns face print columns. In positions ahead and behind these five positions, only one or two tip columns face any print columns, but since $b>a$, the head will never be in a position in which the two outer needle columns face different character areas. Even $b=a$ is permissible, if a position in which the trailing needle column faces the last character column is not a print position. These print columns are not pre-assigned on paper, but result from the selection of the desired space to be occupied by one character. One usually provides for a seven column space (max) per character.

FIG. 4 identifies which print dot was printed by which needle. The character W has been printed in altogether eight different print positions of the print head. The table in FIG. 5, moreover, denotes in which out of eight sequential print positions (identified as column numbers in the matrix), which of the needles had been activated to print out the character W. The print needles are identified by the numbers in the vertical columns along the left margin of the table. Thus, in print position #1 needles 4 and 6 were activated, in position #2 only needle 3; none of the needles were activated in position #5, though needle 8 and/or needle 9, could have been used then.

Generally speaking, in many instances one could print the same dot by different needles in different print positions. However, it is advisable to provide for a control such that as long a period as possible can elapse between activation of the same needle. The maximum cycle frequency of the needles should be less, possibly considerably less than the step rate or print position rate. A print head as per the invention permits the maximum needle activation frequency to be half the print step rate and frequency. This simply means, in terms of a presentation such as FIG. 5, that the same row (needle) is never marked down in two sequential columns.

Had needle 9 been activated in the 5th position as per FIG. 5, it would have been activated with only one print position (#4) in-between of no activation. This is still permissible but should be avoided if possible. In the specific example, one can see that none of the needles is actually activated at a rate faster or more frequent than in a one-fourth print position cycle rate; thus, the activation of a needle at half print speed cycle rate is a rare occasion, and will occur only on printing any horizontal line.

The table in FIG. 5 can also be construed as a schematic representation for a ROM identifying the activation pattern for the printout of that character W. The activation (x) bits as well as the no activation bits are extracted from the locations and activation bits cause operation of the thus selected solenoids in the several print positions identified as columns in FIG. 5.

Another important aspect is the following. Looking at FIG. 2 one can see that only four weak spots are present, namely between needles 5 and 7; 7 and 9; 4 and 6; 6 and 8. These weak spots are located in the head center and these near-center needles are operated by solenoids placed right in the back of the head. The needles are, therefore, not or only very little curved and produce little wear.

The spacing of the needles 3 and 10 from any of its four surrounding needles is almost twice the weak spot thickness, which is significant and affects the needles of strongest curving. By way of example, the needles may have a diameter of 0.37 mm and the weakest spacing is, as stated, only 0.03 mm. The thickness between the bores for needles 3 and 10 and the surrounding needles, is about 0.07 mm. The columns are spaced by about 0.254 mm (about 10 mills) center-to-center. The row center-to-center distance is about 0.4 mm.

The four weak spots in the three middle rows could be avoided by eliminating one of the needles, 6 or 7, and placing it into the middle row instead. That, however, is quite undesirable for reasons of speed. Many characters (E, F, H, etc.) require a horizontal center line. It is important that two needles are available for printing such a line (see also needles 1 and 2 for a top line, and 11 and 12 for a bottom line). Using two needles for printing permits a cycle rate of a single needle to be as low as half the column progression rate.

The invention is not limited to the embodiments described above but all changes and modifications thereof not constituting departures from the spirit and scope of the invention are intended to be included.

I claim:

1. A print head for a matrix printer comprising:

twelve print elements disposed so that their front end tips are arranged in three parallel vertical columns, covering seven rows, there being two outer columns and one middle column accordingly, whereby a first, third, fourth, fifth and seventh row of each of the two outer columns holds a tip of a print element, being respectively one of said twelve elements, and the middle column having the remaining two tips, respectively, in the second and sixth column.

2. Print head as in claim 1, said elements being solenoid driven print needles.

3. A print head as in claim 1, and including means for operating the print head at a cycle rate for each element being at the most half the stepping rate for the rate into sequential print positions.

* * * * *